US006563473B2

(12) United States Patent
Strickland

(10) Patent No.: US 6,563,473 B2
(45) Date of Patent: May 13, 2003

(54) LOW SIDELOBE CONTIGUOUS-PARABOLIC REFLECTOR ARRAY

(75) Inventor: Peter C. Strickland, Ottawa (CA)

(73) Assignee: EMS Technologies Canada, Ltd., Ottawa (CA)

( * ) Notice: Subject to any disclaimer, the term of this patent is extended or adjusted under 35 U.S.C. 154(b) by 0 days.

(21) Appl. No.: 10/079,913

(22) Filed: Feb. 22, 2002

(65) Prior Publication Data

US 2002/0113744 A1 Aug. 22, 2002

Related U.S. Application Data

(60) Provisional application No. 60/270,193, filed on Feb. 22, 2001.

(51) Int. Cl.[7] ..... H01Q 19/14
(52) U.S. Cl. ..... 343/781 P; 343/840
(58) Field of Search ..... 343/781 P, 781 CA, 343/781 R, 836, 837, 839, 840; H01Q 19/14

(56) References Cited

U.S. PATENT DOCUMENTS

| | | | | |
|---|---|---|---|---|
| 3,922,682 A | * | 11/1975 | Hyde | 343/761 |
| 4,407,001 A | | 9/1983 | Schmidt | |
| 4,535,338 A | * | 8/1985 | Ohm | 343/781 CA |
| 5,202,700 A | | 4/1993 | Miller | |
| 5,796,370 A | * | 8/1998 | Courtonne et al. | 343/781 P |
| 5,859,619 A | | 1/1999 | Wu et al. | |
| 5,912,645 A | | 6/1999 | Wight et al. | |
| 6,031,507 A | * | 2/2000 | Aoki | 343/840 |
| 6,049,312 A | | 4/2000 | Lord et al. | |
| 6,052,095 A | | 4/2000 | Ramanujam et al. | |
| 6,262,689 B1 | | 7/2001 | Yamamoto et al. | |
| 6,181,293 B1 | * | 1/2002 | Muhlhauser et al. | 343/840 |

FOREIGN PATENT DOCUMENTS

EP 0 277 206 B1 8/1993

OTHER PUBLICATIONS

High Aperture Efficiency, Wide Angle Scanning Offset Reflector—Craig et al, vol. 41, No. 11, pp 1481–1490, Nov./1993, IEEE Transactions on Antennas and Propagation.

* cited by examiner

*Primary Examiner*—Tho Phan
(74) *Attorney, Agent, or Firm*—Dennis R. Haszko; Robert A. Wilkes; Robert G. Hendry

(57) ABSTRACT

An antenna array of parabolic rectangular reflectors for use in satellite communications. The antenna comprises two parabolic reflectors disposed contiguously on a common outer surface. The common surface forms a continuous antenna aperture. The parabolic reflectors have rectangular side edges which permit the adjacent edges of the parabolic reflectors to be spaced closely. The mouth of each parabolic reflector is focussed on a separate feed. The focus of the feed is not located at the center of the reflector but rather offset. The antenna feeds and the reflector foci are displaced toward the center of the array such that the spacing between the antenna feeds is less than half the length of the antenna. The present invention provides the displacement of each reflector focal point and each antenna feed toward the center of the array.

6 Claims, 5 Drawing Sheets

LOW SIDELOBE CONTIGUOUS-PARABOLIC REFLECTOR ARRAY

This application relates to U.S. Provisional Patent Application No. 60/270,193 filed Feb. 2, 2001.

FIELD OF THE INVENTION

The present invention relates to the use of parabolic reflectors in an antenna system for use in broadband satellite communications. More specifically, the invention relates to an antenna array of parabolic rectangular reflectors having antenna feeds which are offset in order to reduce antenna sidelobe levels.

BACKGROUND OF THE INVENTION

In the field of satellite communications, antenna systems for satellite communication are required to have a broad bandwidth while having a narrow antenna beam width. The broad bandwidth enables the antenna system to both transmit and receive signals over frequency bands of several GHz. The narrow antenna beam width provides a high gain for signals that are received and transmitted over a particular frequency to and from a particular satellite, and provides discrimination between satellites.

Although the antenna beam width is usually focussed on a particular satellite, it may also be necessary to alter the focus of the antenna beam toward another satellite.

Due to the high speed at which aircraft travel, antenna systems which are mounted on aircraft are required to maintain a low profile. The low profile minimizes drag. Typically, an antenna system is placed within a radome that has a height restriction in the range of 4 inches to 12 inches depending on the type of aircraft.

Single parabolic reflectors are not ideal for use in applications requiring a low profile. This is due in part to the fact that a parabolic reflector has a low aspect ratio—it is difficult to optimally illuminate the entire reflector surface when the ratio of the aperture width to height is large. In order to illuminate the entire surface of the parabolic reflector, the reflector itself must be distanced from the reflector feed. For example, a parabolic reflector having a surface width of 28 inches would typically require the feed to be placed at least 10 inches from the reflector. This is well beyond the height restriction of the radome on an aircraft. Regardless of whether the feed is axial or offset, inside the radome, the geometry of a single parabolic reflector is less than ideal for use on an aircraft fuselage.

The use of contiguously disposed parabolic reflectors produces a high gain and a narrow central beamwidth. However, two large sidelobes are produced—one on either side of the antenna beam peak. The sidelobes are introduced due to the modulation of the aperture illumination resultant from the radiation pattern of the antenna feeds. Techniques are required to minimize the impact of modulation, resulting from the aperture illumination, and provide lower sidelobes on either side of the main antenna beam when utilizing an array of contiguously disposed parabolic reflectors.

U.S. Pat. No. 6,049,312, issued to Lord, discloses an antenna system with a plurality of reflectors for generating a plurality of beams. Lord teaches an antenna system comprising a first reflector and a second reflector, as well as corresponding first and second feeds. While the two feeds are offset from their respective reflectors, the first and the second reflector are in a substantially tandem arrangement and not contiguously disposed in array. Rather, Lord teaches a compact antenna configuration whereby the first reflector and the first feed cooperate to form a first antenna beam and the second reflector and the second feed form a second beam. Lord does not discuss the formation of a main antenna beam in which the antenna sidelobe levels may be reduced by displacing the feeds and the foci of the respective reflectors.

U.S. Pat. No. 6,262,689, issued to Yamamoto, discloses an antenna system for communicating with low earth orbit satellites from the ground. In one embodiment, Yamamoto teaches the use of two reflectors separated by a predetermined distance, each reflector having a primary feed for radiating a beam onto its respective reflector, and a switching means to switch the antenna focus between various satellites. However, Yamamoto teaches the tracking of two satellites, one by each of the reflector/feed systems. The Yamamoto patent does not disclose an antenna system which reduces the sidelobe level of the antenna beam.

In view of the above shortcomings of the prior art, the present invention seeks to provide an array of two antenna elements, wherein each antenna element has a feed that is displaced toward the center of the antenna array. Furthermore, the present invention seeks to provide an antenna system utilizing feedhorns, parabolic reflectors, a common aperture surface, and several pairs of contiguously disposed reflectors having displaced feeds to reduce antenna sidelobe levels. Moreover, the present invention seeks to provide an antenna array of parabolic reflectors with lower sidelobes adjacent to the main antenna beam.

SUMMARY OF THE INVENTION

The present invention is an antenna array of parabolic rectangular reflectors for use in satellite communications. The antenna comprises two parabolic reflectors disposed contiguously on a common outer surface. The common surface forms a continuous antenna aperture. The parabolic reflectors have rectangular side edges which permit the adjacent edges of the parabolic reflectors to be spaced closely. The mouth of each parabolic reflector is focussed on a separate feed. The focus of the feed is not located at the center of the reflector but rather offset. The antenna feeds and the reflector foci are displaced toward the center of the array such that the spacing between the antenna feeds is less than half the length of the antenna. The present invention provides the displacement of each reflector focal point and each antenna feed toward the center of the array.

According to the present invention, the antenna feeds are excited coherently in order to produce a narrow well focussed beam. Support struts, located between the feeds and their respective parabolic reflector, are designed such that they minimize the blockage of the antenna aperture. In one embodiment, the antenna array may be mounted on the fuselage of an aircraft. The antenna is steered mechanically in elevation and azimuth to maintain the antenna attitude directed toward a particular satellite at all times. Finally, the displacement of the antenna feeds and reflector foci result in lower sidelobes adjacent to the main antenna beam.

BRIEF DESCRIPTION OF THE DRAWINGS

The invention will now be described with reference to the drawings, in which.

DETAILED DESCRIPTION

Figure 1:
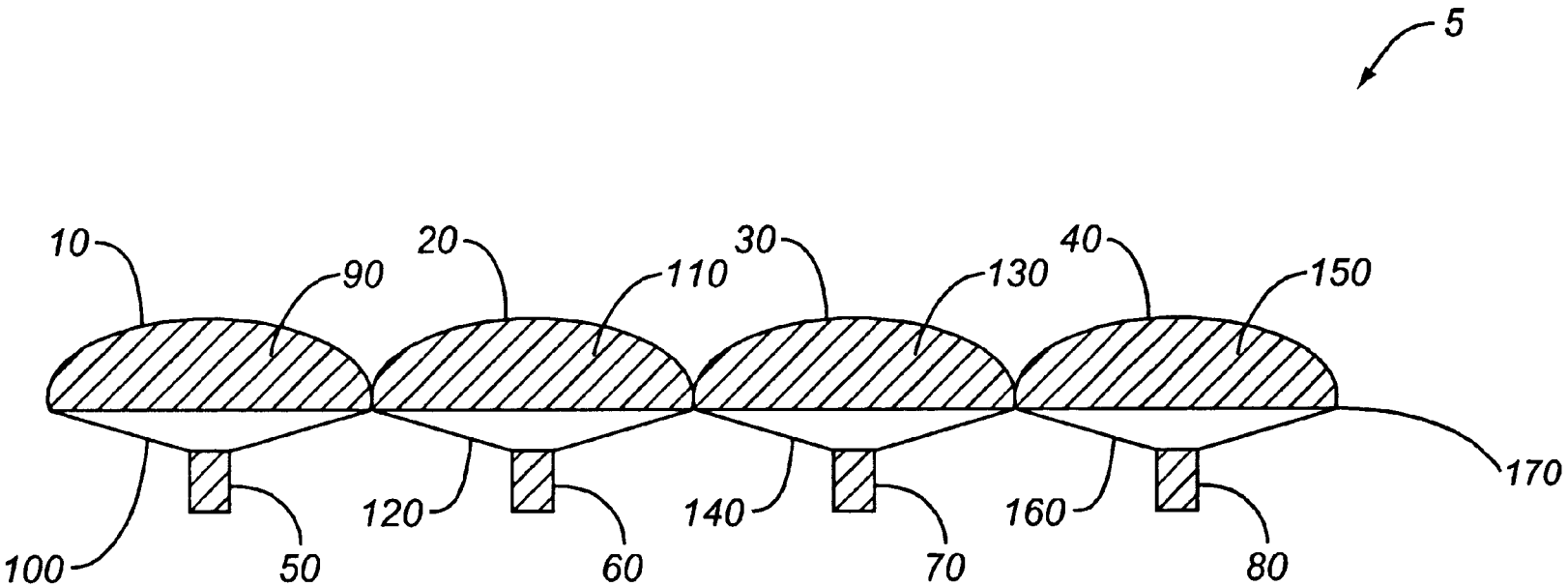
PRIOR ART FIG. 1
FIG. 1 is a side view of the antenna system having parabolic reflectors disposed contiguously in a linear array of the prior art.

FIG. 1 illustrates a side view of the antenna system 5 of the prior art. The antenna system 5 consists of four antenna elements 10, 20, 30, 40, and four antenna element feeds 50, 60, 70, 80, respectively. The antenna elements are identical. The antenna element 10 is comprised of a rectangular parabolic reflector 90 and a support strut 100. The antenna element 20 has both a rectangular parabolic reflector 110 and a support strut 120. The antenna element 30 has both a rectangular parabolic reflector 130 and a support strut 140. Finally, the antenna element 40 has both a rectangular parabolic reflector 150 and a support strut 160.

It should be further explained that the rectangular parabolic reflectors 90, 110, 130, 150 have a rectangular side edge configuration. The rectangular parabolic reflector differs from the conventional parabolic reflectors which have a circular or an elliptical edge configuration. The rectangular edge configuration permits the parabolic reflectors 90, 110, 130, 150, to be adjacent, without gaps, forming a larger common rectangular aperture. The contiguous disposition of the parabolic reflectors 90, 110, 130, 150 is one factor which contributes to an optimal illumination of the antenna array and to the antenna system 5 having a low profile. Each rectangular parabolic reflector shown in FIG. 1 has a central focus point that is facing directly in line with a corresponding antenna feed.

The support struts 100, 120, 140, 160 are support members for the feeds. However, the support struts are non-essential elements in that the element feeds 50, 60, 70, 80 may be attached to the parabolic reflectors 90, 110, 130, 150 by other means. The support struts 100, 120, 140, 160 are designed to provide for minimal blockage of the paraboloidal apertures so as not to interfere with the element feeds 50, 60, 70, 80.

The element feeds 50, 60, 70, 80 each transmit a guided wave deriving, for instance, from a coaxial cable. Alternatively, the element feeds receive an unguided wave propagating through space. An unguided wave reflects off the parabolic reflector surface and would then be received at the element feed. To transmit a guided wave, each element feed is excited in phase through a power splitting/combining means, shown in FIG. 3. As each element feed is excited, the combined radiation pattern of the antenna elements produces a narrow beam.

The "front" of each parabolic reflector 90, 110, 130, 150 forms part of the common aperture surface 170. The concave surface of each parabolic reflector 90, 110, 130, 150 faces the common aperture surface 170. This common aperture surface 170 enables the rectangular parabolic reflectors to form a continuous antenna aperture in order to further narrow and focus the antenna beam.

Figure 2:
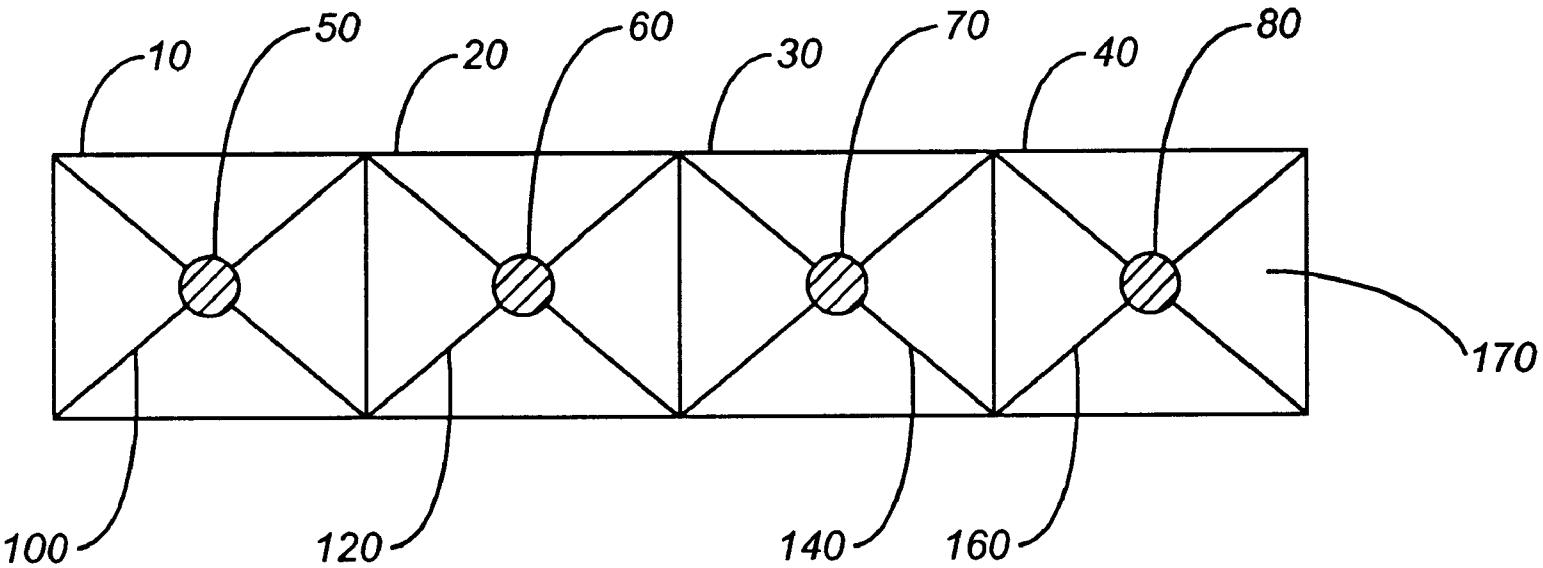
PRIOR ART FIG. 2
FIG. 2 is a bottom view of the antenna system of FIG. 1 of the prior art.

FIG. 2, of the prior art, illustrates a bottom view of the antenna system 5 described in FIG. 1. In FIG. 2, the common aperture surface 170 is attached to each of the support struts 100, 120, 140, 160 each of which are attached to the element feeds 50, 60, 70, 80. The central foci of each reflector is directly above the element feeds 50, 60, 70, 80.

Figure 3:
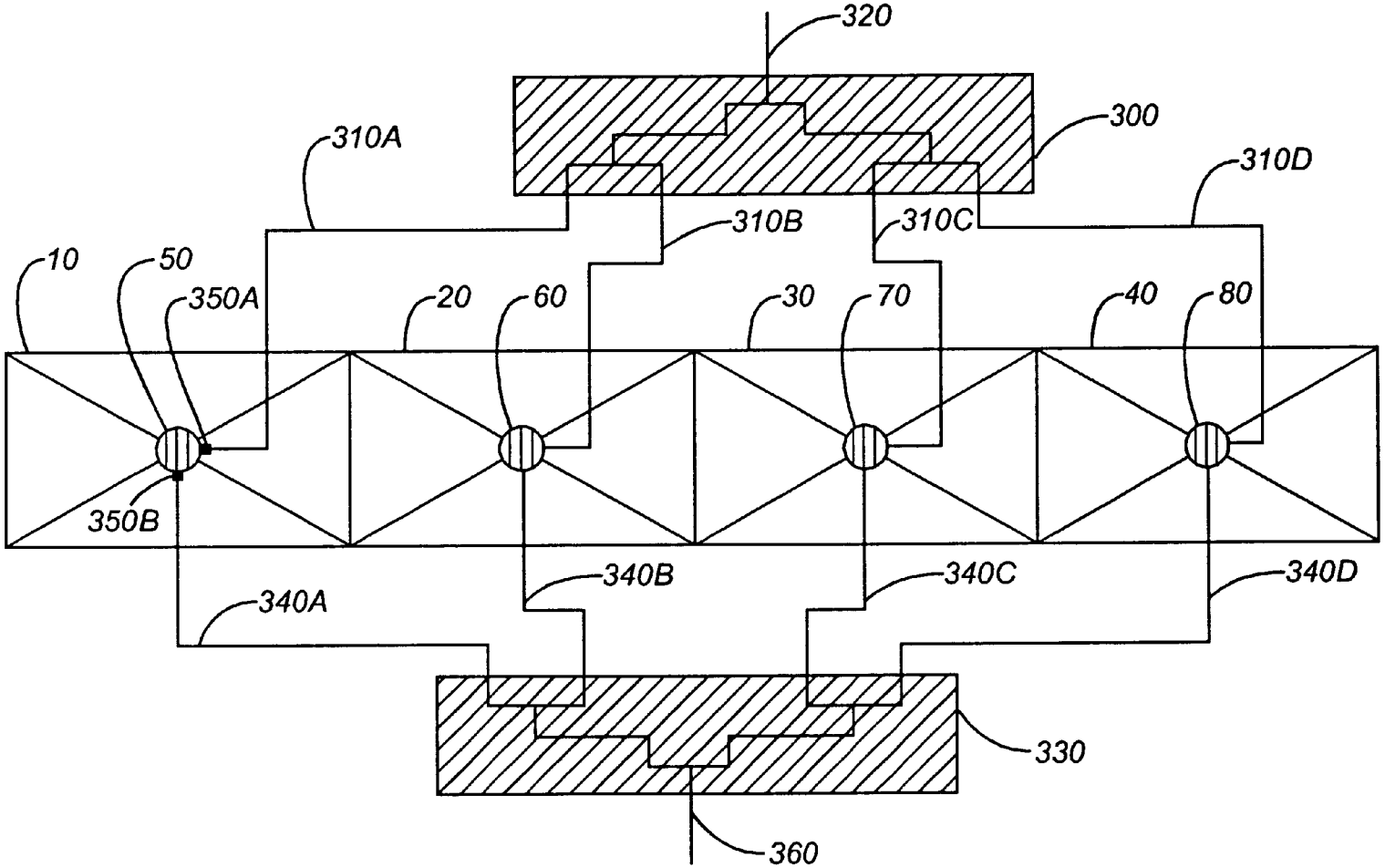
PRIOR ART FIG. 3
FIG. 3 is a bottom view of the antenna system of FIG. 1, further including a power splitter/combiner, of the prior art.

FIG. 3 illustrates the antenna system 5 of FIG. 1 and 2 of the prior art in combination with a power splitter/combiner. In FIG. 3, the power splitter/combiner is shown as two separate elements, although they may be one element. The power divider 300 has four connections 310A, 310B, 310C, 310D, which are connected to the antenna feeds 50, 60, 70, 80, respectively. The four connections 310A, 310B, 310C, 310D may be a coaxial cable or any other connecting means. The power divider 300 also has an input beam port 320. The use of four connections 310A, 310B, 310C, 310D enables the antenna system 5 to form an antenna beam which utilizes all of the parabolic reflectors.

The power combiner 330 also has four connections 340A, 340B, 340C, 340D, each of which are connected to antenna feeds 50, 60, 70, 80, respectively. The antenna feeds each have two connections. The antenna feed 50 is attached to the power combiner 330 through a connection 340A and to the power splitter 300 through a connection 310A. The antenna feed 60 is attached to the power combiner 330 through a connection 340B and to the power splitter 300 through a connection 310B. The antenna feed 70 is attached to the power combiner 330 through a connection 340C and to the power splitter 300 through a connection 310C. Accordingly, the antenna feed 80 is attached to the power combiner 330 through a connection 340D and to the power splitter 300 through a connection 310D.

Also, each antenna feed 50, 60, 70, 80 has two connections which are attached at respective input/output ports. In FIG. 3, the antenna feed 50 has an input port 350A which is coupled to the connection 310A and in turn connected to the power splitter 300. The power splitter sends a signal and the required input power to the antenna feed 50. The antenna feed 50 has an output port 350B which is coupled to the connection 340A and in turn connected to the power combiner 330. There may be more than one output port at each antenna feed. Each output port represents a particular horizontal or vertical polarisation. The horizontal and vertical polarisation permits the antenna feeds 50, 60, 70, 80 to excite the antenna elements at various phases. As such, through the appropriate phase and amplitude combining of each of the element feeds 50, 60, 70, 80, the antenna elements 10, 20, 30, 40 may be excited in combination such that they produce an antenna beam that may be focussed in various directions.

While FIG. 3 only shows two connections to each element feed 50, 60, 70, 80, there may be more than one output connection to the power combiner 330. Each additional output connection would be coupled to a separate power combiner. Each additional power combiner would also be connected to the main transceiver equipment located on the aircraft. In a dual-band system each element feed would have four connections corresponding to a horizontal and a vertical polarisation for each of the two bands.

Also, an output beam port 360 is connected to the power combiner 330. Both the input beam port 320 and the output beam port 360 may be coupled to the aircraft transceiver equipment that uses the antenna system.

Figure 4:
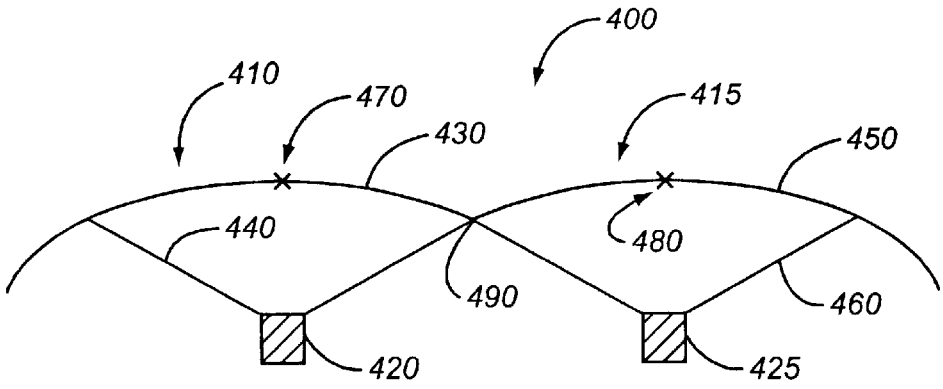
FIG. 4 is a schematic side view of an antenna system having two parabolic reflectors with offset foci and antenna feeds located at each of the offset foci according to the present invention.

FIG. 4 illustrates an antenna array 400 similar to the prior art, yet in contrast, the antenna elements, belonging to the antenna array 400, have offset antenna element foci and antenna feeds which are displaced in order to reduce antenna sidelobe levels. According to the present invention, the antenna array 400 of FIG. 4 consists of two antenna elements 410, 415 and two antenna feeds 420, 425. The antenna element 410 further comprises a rectangular parabolic reflector 430 and a support strut 440. Similarly, the antenna element 420 comprises a rectangular parabolic reflector 450 and a support strut 460.

In contrast to FIG. 1, FIG. 4 illustrates the use of an offset reflector focus point. The antenna feed 420 and the focus point 470 of the parabolic reflector 430 are not at the centre of the antenna element 410. Rather, the antenna feed 420 and the focus point 470 are displaced toward the centre of the rectangular aperture of the parabolic reflector 430(shown clearly in FIG. 5). The antenna feed 425 and the focus point 480 are also displaced toward the centre of the rectangular aperture of the parabolic reflector 450. In fact, both antenna feeds 420, 425 and correspondingly both focus points 470, 480 have been displaced such that they are closer to the centre point 490 of the antenna array 400.

Figure 5:
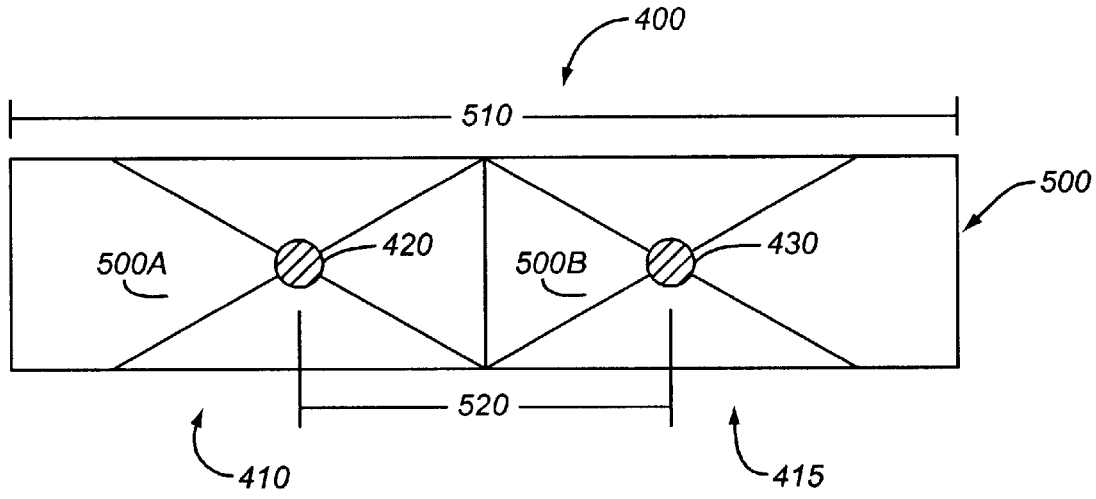
FIG. 5 is a bottom view of the antenna system of FIG. 4 of the present invention.

FIG. 5 is a bottom view of the antenna array 400 which illustrates the spacing between antenna feeds 420, 425 according to the present invention. Similar to the prior art, the "front" of the each parabolic reflector 430, 450 forms part of a common aperture surface 500. The common The common aperture surface 500 is comprised of two rectangular aperture surfaces 500A, 500B and having a particular antenna system length 510. Each of the two rectangular aperture surfaces 500A, 500B correspond to each of the two antenna elements 410, 415, respectively. As opposed to the antenna feed 420 being located in the centre of the rectangular aperture 500A it is instead displaced toward the centre of the common aperture surface 500. The antenna feed 430 is also displaced toward the centre of the common aperture surface 500. The antenna feeds 420, 425, are displaced towards the centre of the antenna array 400 such that the spacing between the antenna feeds 420, 425, is less than half the antenna system length 510. The displacement of the parabolic reflector foci 470, 480, correspond to the offset antenna feed positions. As such, the parabolic reflector foci 470, 480 are displaced towards the centre of the antenna array 400 such that the spacing 520 between the reflector foci 470, 480 is less than half the antenna system length 510.

According to the present invention, the displacement of the antenna feeds 420, 425 and the reflector foci 470, 480 reduces the antenna sidelobes adjacent to the main antenna beam of the antenna radiation pattern. In a dual-parabolic antenna system, the beamwidth of each individual parabolic reflector remains constant while the phase centers of their antenna beam are moved closer together. Thus, the first sidelobes, also termed grating lobes, are pushed further from the main antenna beam and suppressed by the narrow radiation pattern of the individual parabolic reflectors 430, 450.

Figure 6:
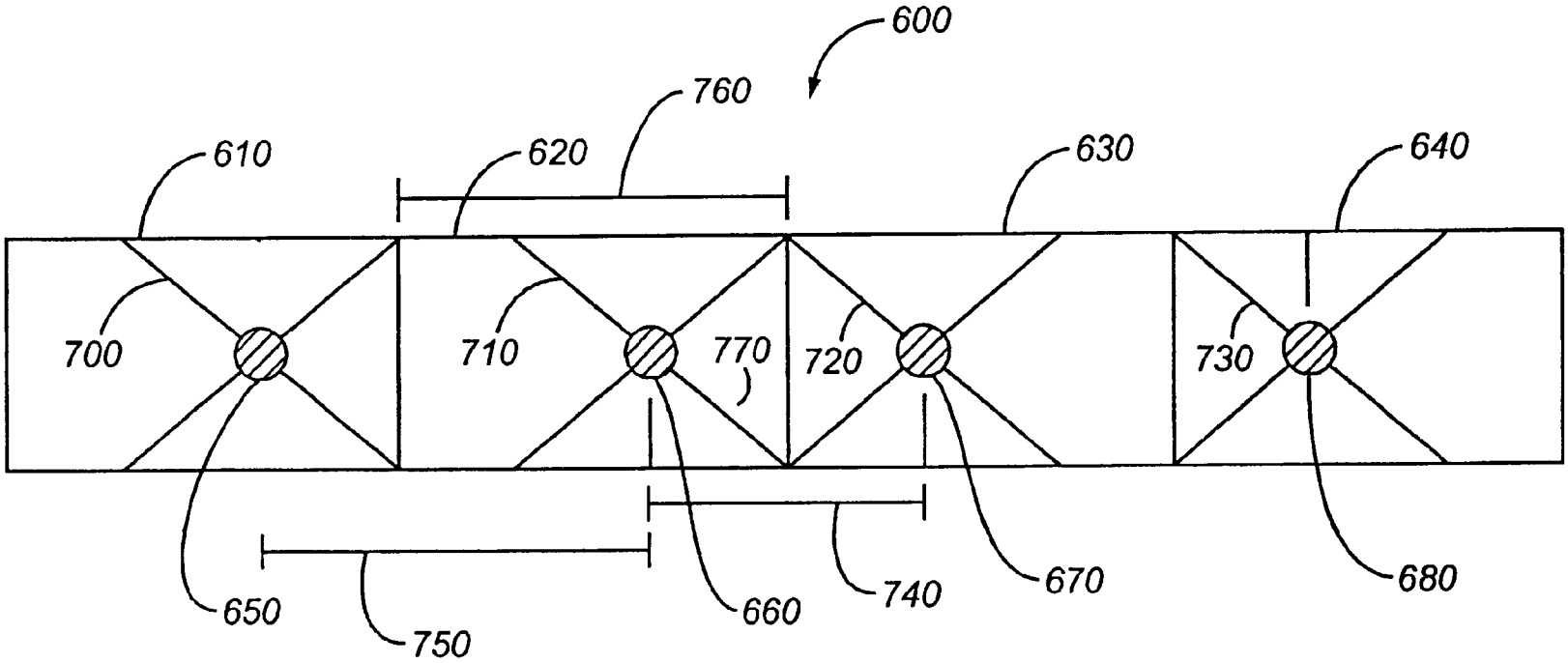
FIG. 6 is a front view of an antenna system having a plurality of parabolic reflectors with offset foci and antenna feeds displaced toward the center of the antenna array according to an alternative of the present invention.

FIG. 6 is a frontal view of an antenna array 600 according to an alternative embodiment of the present invention. The antenna array 600 consists of four antenna elements 610, 620, 630, 640 and four antenna feeds 650, 660, 670, 680. Each of the four antenna elements are comprised of both a parabolic reflector (similar to that of FIG. 1) and a support strut. Each of the four support struts 700, 710, 720, 730 are each connected to the antenna feeds 650, 660, 670, 680, respectively.

According to this embodiment, the feed spacings are not uniform, in that the feed spacing 740, between the antenna feeds 660 and 670, is closer than the feed spacing 750, between the antenna feeds 650 and 660. Each of the four antenna feeds 650, 660, 670, 680 are displaced toward the centre of the antenna array 600. In this alternative embodiment, the feed spacing between antenna feeds, in an array of more than two antenna elements, would be less than the length 760 of a rectangular aperture surface 770 for a single antenna element. Typically, the average spacing between antenna feeds would be lower than that obtained with conventional feed spacings since at the very least the two outer feeds 650, 680 would be displaced towards the centre of the array 600. FIG. 6 further illustrates an antenna array in which all of the antenna feeds are displaced towards the centre of the array. The reflector foci of each of the four antenna elements 610, 620, 630, 640 are displaced toward the centre of the array. As such, the sidelobe levels of the main antenna beam are suppressed by the narrow radiation pattern of the individual antenna elements 610, 620, 630, 640.

It should be mentioned that the antenna feeds of both the antenna array 400 and the antenna array 600 may be connected to a power splitter 300 and power combiner 330 of FIG. 3. However, the power splitter 300 and the power combiner 330 need not be two separate units but rather a single power splitting/combining unit.

Although the antenna system is advantageous for use on an aircraft, the present invention also lends itself to applications on vehicles or at various stations on the ground that are in communication with satellites.

What is claimed is:

1. An antenna array including:

a common aperture surface; and two parabolic rectangular reflectors, each parabolic rectangular reflector having a concave side, each parabolic rectangular reflector being disposed contiguously in a linear array forming a larger common rectangular aperture without gaps in illumination, the two parabolic reflectors being disposed on either side of a centre point of the antenna array, each parabolic rectangular reflector having a parabolic focus, each parabolic focus being displaced equally toward the center point of the antenna array, each parabolic reflector connected to either a first reflector feed or a second reflector feed, the first reflector feed being located at the parabolic focus of its corresponding parabolic reflector, the second reflector feed being located at the parabolic focus of its corresponding parabolic reflector, and the two parabolic rectangular reflectors being supported by the common aperture surface between the two parabolic rectangular reflectors and both the first reflector feed and the second reflector feed.

2. An antenna array as defined in claim 1, further including a power splitting and combining means for feeding input power to the first reflector and the second reflector feed.

3. An antenna array as defined in claim 1, wherein the antenna array is for use in satellite communications.

4. An antenna array including:

a common aperture surface; and at least two parabolic rectangular reflectors, each of the at least two parabolic rectangular reflectors having a concave side, each parabolic rectangular reflector being disposed contiguously in a linear array forming a larger common rectangular aperture without gaps in illumination, at least two parabolic reflectors being disposed on either end of a centre point of the antenna array, each parabolic rectangular reflector having a parabolic focus, at least two parabolic rectangular reflector having parabolic foci being displaced equally toward the center point of the antenna array, each parabolic reflector connected to a reflector feed, the reflector feed being located at the parabolic focus of its corresponding parabolic reflector, and the at least two parabolic rectangular reflectors being supported by the common aperture surface between the two parabolic rectangular reflectors and their respective antenna feed.

5. An antenna array as defined in claim 4, further including a power splitting and combining means for feedinginput power to each reflector feed.

6. An antenna array as defined in claim 4, wherein the antenna array is for use in satellite communications.

* * * * *